US007554268B2

(12) United States Patent
Kim

(10) Patent No.: US 7,554,268 B2
(45) Date of Patent: Jun. 30, 2009

(54) PLASMA DISPLAY PANEL WITH SUSTAIN ELECTRODE STRUCTURE

(75) Inventor: Dong-Hyun Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 436 days.

(21) Appl. No.: 11/383,280

(22) Filed: May 15, 2006

(65) Prior Publication Data

US 2006/0284546 A1 Dec. 21, 2006

(30) Foreign Application Priority Data

Jun. 20, 2005 (KR) ..... 10-2005-0053058

(51) Int. Cl.
*H01J 17/49* (2006.01)

(52) U.S. Cl. ..... 313/582; 313/583; 313/584; 313/586; 313/587

(58) Field of Classification Search ..... 313/582–587
See application file for complete search history.

(56) References Cited

U.S. PATENT DOCUMENTS

| | | | | |
|---|---|---|---|---|
| 6,522,072 | B1 * | 2/2003 | Yura et al. | 313/582 |
| 7,009,587 | B2 * | 3/2006 | Nishimura et al. | 345/67 |
| 2004/0027068 | A1 * | 2/2004 | Chien et al. | 313/581 |
| 2004/0130268 | A1 * | 7/2004 | Mun et al. | 313/582 |
| 2004/0135507 | A1 * | 7/2004 | Park et al. | 313/582 |
| 2005/0023978 | A1 * | 2/2005 | Okigawa et al. | 313/582 |
| 2005/0029941 | A1 * | 2/2005 | Kwon et al. | 313/582 |
| 2006/0001675 | A1 * | 1/2006 | Kwon et al. | 345/584 |
| 2006/0091804 | A1 * | 5/2006 | Rho et al. | 313/582 |
| 2007/0285013 | A1 * | 12/2007 | Amano | 313/584 |

FOREIGN PATENT DOCUMENTS

| | | |
|---|---|---|
| JP | 08-315735 | 11/1996 |
| JP | 2002-134035 | 5/2002 |
| JP | 2002-216636 | 8/2002 |
| WO | 02-17345 | 2/2002 |

* cited by examiner

*Primary Examiner*—Joseph L Williams
*Assistant Examiner*—Kevin Quarterman
(74) *Attorney, Agent, or Firm*—H.C. Park & Associates, PLC

(57) ABSTRACT

Provided is a plasma display panel including a first substrate and a second substrate facing each other, barrier ribs that define a plurality of discharge cells, address electrodes which extend across the discharge cells and a plurality of pairs of sustain electrodes which cross the address electrodes and generate a sustain discharge. Two sustain electrodes of a sustain electrode pair each include two or more electrode portions and connection portions for electrically coupling the electrode portions. Each electrode portion has a line width B, and each connection portion has a line width S. The ratio of the line width S to the line width B is $0.20 \leqq S/B \leqq 0.92$ to balance improved brightness with reduced power consumption for the plasma display panel. Further, the sustain electrode can be manufactured so the electrode portions are formed integrally with the connection portions to facilitate ease of manufacturing.

20 Claims, 5 Drawing Sheets

PLASMA DISPLAY PANEL WITH SUSTAIN ELECTRODE STRUCTURE

CROSS REFERENCE TO RELATED APPLICATION

This application claims priority to and the benefit of Korean Patent Application No. 10-2005-0053058, filed on Jun. 20, 2005, which is hereby incorporated by reference for all purposes as if fully set forth herein.

BACKGROUND OF THE INVENTION

1. Field of the Invention

The present invention relates to a plasma display panel, and more particularly, to a plasma display panel which can be easily manufactured and has improved brightness and reduced power consumption.

2. Discussion of the Background

Conventional cathode-ray tube display devices have been recently replaced in the consumer electronics market by plasma display panels (PDPs). Plasma display panels have a discharge gas contained between two substrates. Each substrate has a plurality of electrodes, including address electrodes and sustain electrodes, formed thereon. A discharge voltage is applied to sustain electrodes to excite discharge gas. The excited discharge gas generates ultraviolet rays that excite a phosphor layer, and the excited phosphor layer emits visible light to form the desired image on the PDP.

A conventional AC-type PDP 10, as shown in FIG. 1, includes an upper plate 50, on which an image is displayed, and a lower plate 60 coupled to the upper substrate 50 in parallel. Sustain electrode pairs 12 having an X electrode 31 and a Y electrode 32 are arranged on a front substrate 11 of the upper plate 50. Address electrodes 22 are arranged on a rear substrate 21 of the lower plate 60 and face the front substrate 11, on which the sustain electrode pairs 12 are arranged. Address electrodes 22 extend in a first direction and cross with the X electrode 31 and the Y electrode 32, which both extend in a second direction substantially perpendicular to the first direction A first dielectric layer 15 is arranged on the front substrate 11 to cover the sustain electrode pairs 12 and a second dielectric layer 25 is arranged on the rear substrate 21 to cover the address electrodes 22. A protective layer 16 of MgO is arranged on the rear surface of the first dielectric layer 15. Barrier ribs 30 are arranged on the second dielectric layer 25 to maintain a discharge distance between the front substrate and rear substrate and prevent electro-optical cross-talk between adjacent discharge cells. Red phosphor layers, green phosphor layers, and blue phosphor layers 26 are coated on both side surfaces of the barrier ribs 30 and on the first dielectric layer 25 between barrier ribs 30.

The X electrode 31 includes transparent electrode 31*a* and bus electrode 31*b*, and the Y electrode 32 includes transparent electrode 32*a* and bus electrode 32*b*. The space formed where an X electrode 31, a Y electrode 32, and an address electrode 22 cross with each other defines a discharge unit such as unit discharge cell 70. The transparent electrode 31*a* and transparent electrode 32*a* are made of a transparent conductive material, which can generate discharge and does not prevent light emitted from the phosphor layers 26 from being directed toward the front substrate 11, such as Indium Tin Oxide (ITO). However, a transparent conductor such as ITO may have a large resistance. Accordingly, if the sustain electrodes are formed of only the transparent material, a voltage loss and driving power may increase, and the response speed may be reduced. Therefore, the bus electrode 31*b* may be formed of metal with a narrow line width coupled with the transparent electrode 31*a*, and bus electrode 32*b* may be formed of metal with a narrow line width coupled with the transparent electrode 32*a*.

However, a sustain electrode including a bus electrode and a transparent electrode may be expensive and time-consuming to produce since the transparent electrode material may be expensive and separate steps may be required for coupling the bus electrode and the transparent electrode.

In order to solve these problems, a sustain electrode having only a bus electrode has been developed. However, since the discharge is not generated well using the standard bus electrodes alone, brightness of the light emitted from the panel may be reduced and driving power consumption may increase.

SUMMARY OF THE INVENTION

This invention provides a plasma display panel which can be easily manufactured and has brightness and reduced power consumption.

Additional features of the invention will be set forth in the description which follows, and in part will be apparent from the description, or may be learned by practice of the invention.

The present invention discloses a plasma display panel including a first substrate, a second substrate facing the first substrate, and a first pair of sustain electrodes arranged between the first substrate and the second substrate to generate a sustain discharge. Further, a first sustain electrode of the first pair of sustain electrodes includes a first electrode portion, a second electrode portion, and a connection portion for electrically coupling the first electrode portion and the second electrode portion, and the ratio S/B of a line width S of the connection portion to a line width B of the first electrode portion is $0.20 \leqq S/B \leqq 0.92$.

The present invention also discloses a plasma display panel including a first substrate, a second substrate facing the first substrate, barrier ribs arranged between the first substrate and the second substrate and defining a plurality of discharge cells, address electrodes which extend in a first direction and cross with discharge cells, a plurality of sustain electrode pairs, which extend in a second direction and cross with the address electrodes, a first dielectric layer which covers the sustain electrodes, a second dielectric layer which covers the address electrodes, phosphor layers disposed in the discharge cells, and discharge gas disposed between the first substrate and the second substrate in the discharge cells. Further, a first sustain electrode of a sustain electrode pair includes a first electrode portion, a second electrode portion, and a connection portion for electrically coupling the first electrode portion and the second electrode portion.

The present invention also discloses a plasma display panel including a first substrate, a second substrate facing the first substrate, and a sustain electrode arranged between the first substrate and the second substrate, and including a first electrode portion and a second electrode portion both extending in a first direction, and a connection portion coupled between the first electrode portion and the second electrode portion and extending in a second direction. Further, the first direction is substantially perpendicular to the second direction, and a ratio S/B of a line width S of the connection portion to a line width B of the first electrode portion is $0.20 \leqq S/B \leqq 0.92$.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE INVENTION

Figure 1:
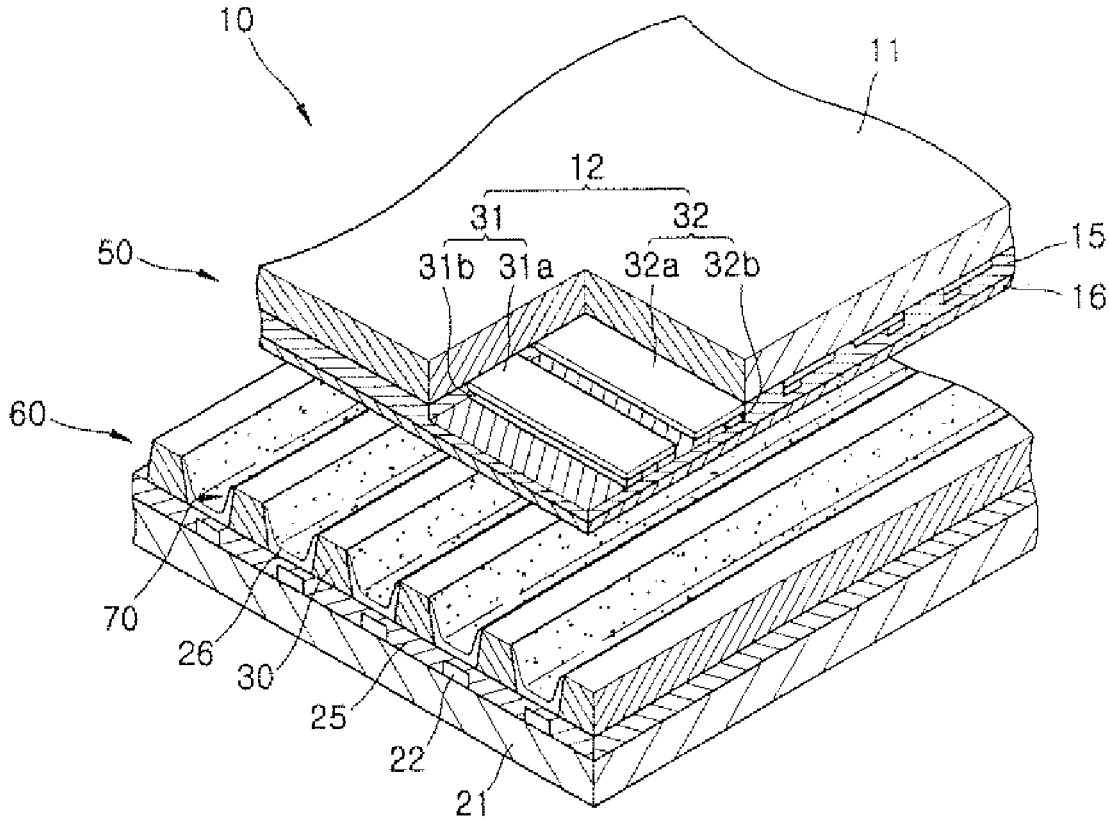
FIG. 1 (PRIOR ART)
FIG. 1 is an exploded perspective view of a conventional plasma display panel.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
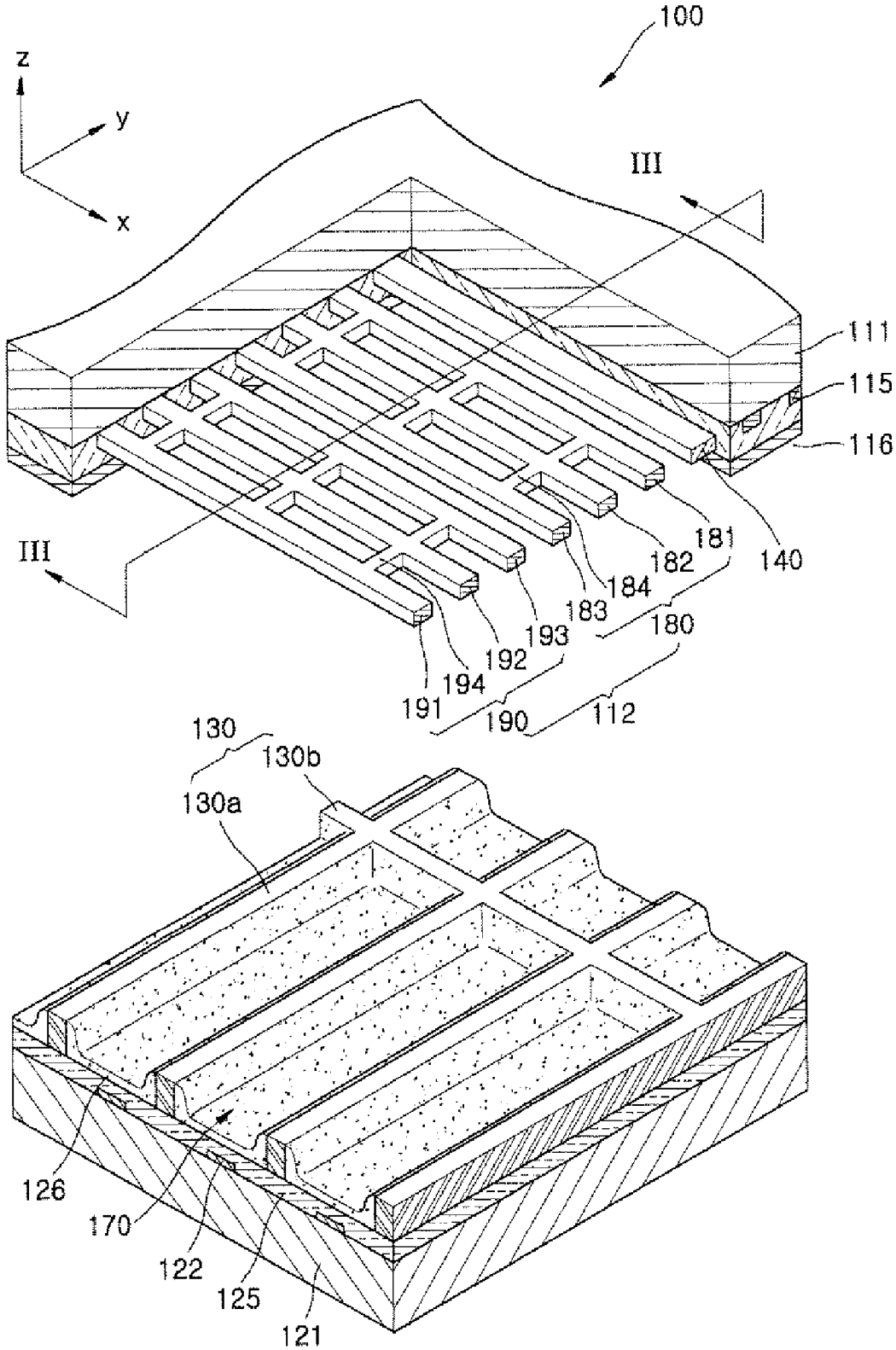
FIG. 2 is a partial cutaway exploded perspective view of a plasma display panel according to an exemplary embodiment of the present invention.
Figure 3:
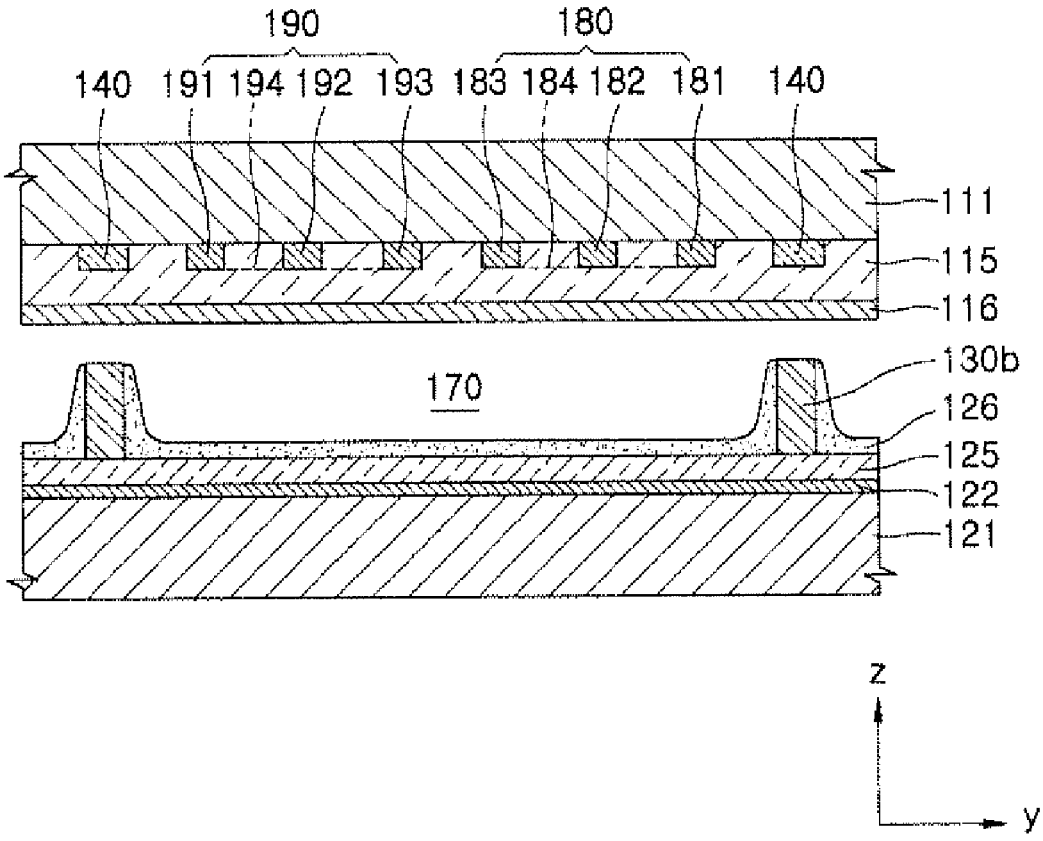
FIG. 3 is a cross-sectional view taken along line III-III of FIG. 2.
Figure 4:
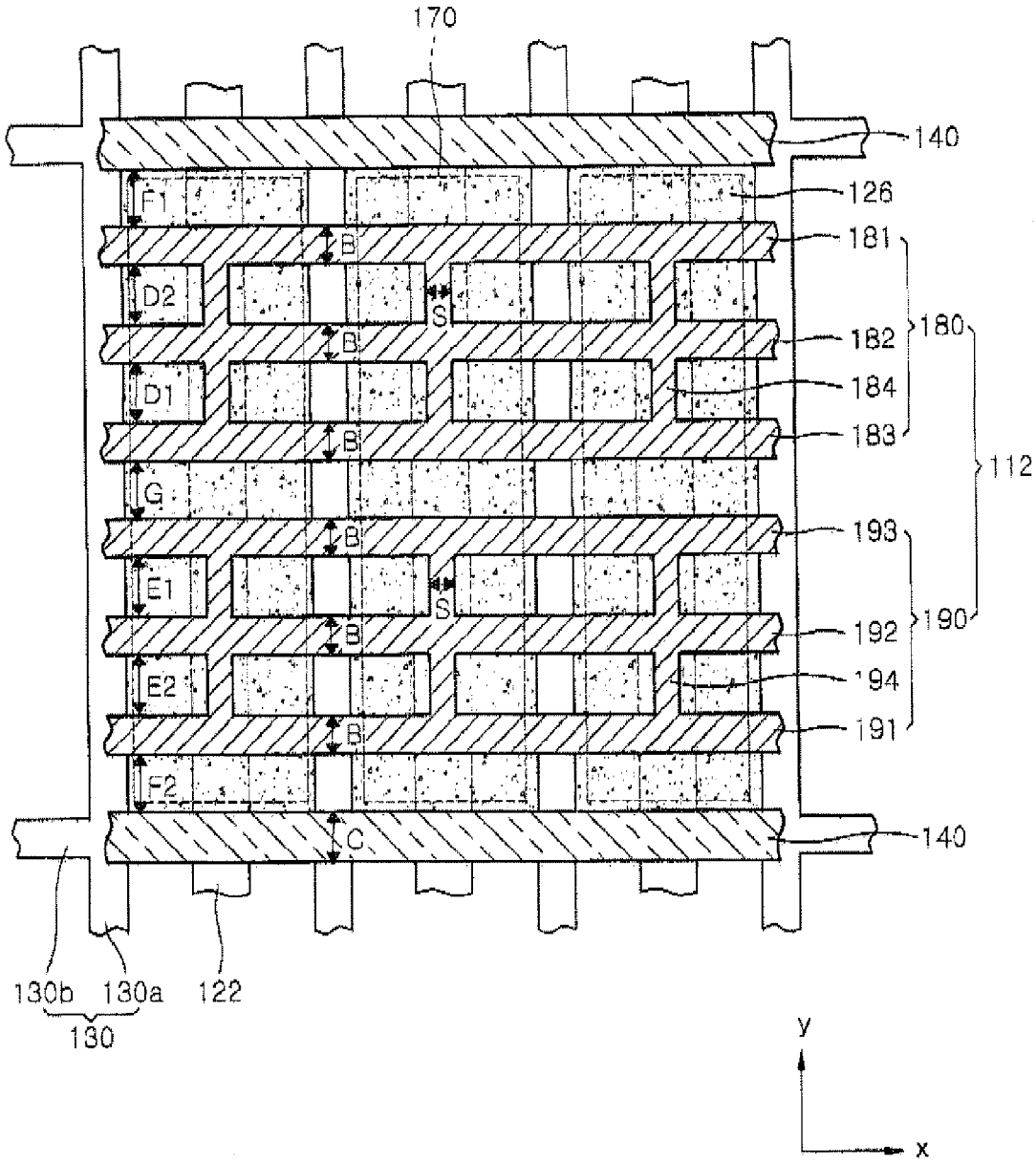
FIG. 4 is a plan view illustrating the arrangement of discharge cells and sustain electrodes shown in FIG. 2.

FIG. 2, FIG. 3, and FIG. 4 show a plasma display panel 100 according to an exemplary embodiment of the present invention. FIG. 2 is an exploded perspective view of the plasma display panel 100, FIG. 3 is a cross-sectional view taken along line III-III of FIG. 2, and FIG. 4 is a plan view illustrating the arrangement of discharge cells 170, barrier ribs 130, sustain electrode pairs 112, and address electrodes 122.

The plasma display panel 100 according to the present exemplary embodiment includes a first substrate 111, a second substrate 121, sustain electrode pairs 112, the address electrodes 122, the barrier ribs 130, a protective layer 116, phosphor layers 126, a first dielectric layer 115, a second dielectric layer 125, and discharge gas (not shown).

The first substrate 111 can be made of a material having excellent light transmission, such as glass. To reduce reflection and improve contrast, the first substrate 111 may be made of a colored material. The second substrate 121 is spaced apart from the first substrate 111 and can also be made of a material having excellent light transmission such as glass. Similar to the first substrate 111, the second substrate 121 may also be made of a colored material. Visible rays generated in the discharge cells 170 may be emitted through the first substrate 111 and the second substrate 121 or through only one of the first substrate 111 or the second substrate 121. However, in the present exemplary embodiment as shown in FIG. 2, the visible rays generated in the discharge cells 170 are emitted through the first substrate 111.

The barrier ribs 130, which define a plurality of discharge cells 170 for generating discharge between the first substrate 111 and the second substrate 121, are arranged between the first substrate 111 and the second substrate 121. The barrier ribs 130 may prevent optical and electrical cross-talk between adjacent discharge cells 170. In the present exemplary embodiment, the barrier ribs 130 include first barrier rib portions 130*a*, which extend in a direction in which the address electrodes 122 extend (the y direction as shown on FIG. 2), and second barrier rib portions 130*b*, which extend in a direction that crosses with the first barrier rib portions 130*a* (the x direction as shown on FIG. 2) such that the discharge cells 170 may have a rectangular cross section. However, the shape of the barrier ribs is not limited hereto. For example, the barrier ribs may have an open shape such as a stripe or a closed shape such as a waffle, a matrix, or a delta, as long as a plurality of discharge spaces can be formed. The cross section of the closed barrier ribs may be polygonal, such as triangular or pentagonal, or may be in other geometric shapes such as circular or elliptical.

The sustain electrode pairs 112 are arranged on the first substrate 111 and face the second substrate 121. A sustain electrode pair 112 includes an X electrode 180 and a Y electrode 190. The X electrode 180 and the Y electrode 190 generate plasma discharge in a discharge cell 170.

The X electrode 180 includes a first electrode portion 181, a second electrode portion 182, a third electrode portion 183, and connection portions 184, which are coupled between adjacent electrode portions. The first electrode portion 181, the second electrode portion 182, and the third electrode portion 183 are arranged in parallel, spaced at predetermined intervals, and extend in a direction that crosses with the address electrodes 122. The first electrode portion 181, the second electrode portion 182, and the third electrode portion 183 may extend in the x direction as shown in FIG. 2. The first electrode portion 181, the second electrode portion 182, and the third electrode portion 183 may be sequentially arranged from the edge to the center of a discharge cell 170. For example, the first electrode portion 181 may be arranged nearest the edge of a discharge cell 170 while the third electrode portion 183 may be arranged nearest the center of a discharge cell 170.

In the present exemplary embodiment, the X electrode 180 is shown to include three electrode portions. However, the present invention is not limited to this arrangement. As necessary, the X electrode 180 may have a plurality of electrode portions, specifically between two and four electrode portions.

The connection portions 184 electrically couple the first electrode portion 181, the second electrode portion 182, and the third electrode portion 183. In the present exemplary embodiment, a connection portion 184 may be arranged in a discharge cell 170 in a direction substantially perpendicular to the direction in which the first electrode portion 181, the second electrode portion 182, and the third electrode portion 183 extend. For example, as shown in FIG. 2, a connection portion 184 may extend in the y direction. However, the present invention is not limited to this arrangement, and a connection portion 184 may extend in a direction not substantially perpendicular to the direction of the first electrode portion 181, the second electrode portion 182, and the third electrode portion 183.

The first electrode portion 181, the second electrode portion 182, the third electrode portion 183, and the connection portions 184 of the X electrode 180 may be formed of conductive materials, which may include a metal or ceramic material. Such metal may include Ag, Pt, Pd, Ni, or Cu, and such ceramic material may include Indium Tin Oxide (ITO) or Antimony Tin Oxide (ATO). In order to increase emission of secondary electrons, the first electrode portion 181, the second electrode portion 182, the third electrode portion 183, and the connection portions 184 of the X electrode 180 may be formed of a material that includes carbon nanotubes.

The first electrode portion 181, the second electrode portion 182, the third electrode portion 183, and the connection portions 184 of the X electrode 180 may be formed of a single layer or multiple layers. If the first electrode portion 181, the second electrode portion 182, the third electrode portion 183, and the connection portions 184 of the X electrode 180 are formed of multiple layers, one layer may include a different material from another layer.

The first electrode portion 181, the second electrode portion 182, the third electrode portion 183, and the connection portions 184 of the X electrode 180 may be integrally formed to simplify the manufacturing process. For example, the X electrode 180 may be formed of a thick film by a printing method using a photosensitive paste, or a thin film by sputtering or evaporation. The first electrode portion 181, the second electrode portion 182, and the third electrode portion 183 may have the same line width B as shown on FIG. 4. Also, to increase brightness and reduce power consumption, the ratio (S/B) of the line width S of a connection portion 184 to the line width B of the first electrode portion 181, the second electrode portion 182, and the third electrode portion 183 may be $0.20 \leqq S/B \leqq 0.92$. The line width B of the first electrode portion 181, the second electrode portion 182, and the third electrode portion 183 may be between about 20 μm to about 150 μm. The line width B of the first electrode portion 181, the second electrode portion 182, and the third electrode portion 183 and the line width S of the connection portions 184 will be described in further detail below.

The Y electrode 190 may include a first electrode portion 191, a second electrode portion 192, a third electrode portion 193, and connection portions 194. The Y electrode 190 may have a substantially similar structure as the X electrode 180 in each discharge cell 170 to equalize the discharge. The structure, operation, and material of the first electrode portion 191, the second electrode portion 192, the third electrode portion 193 and the connection portions 194 of the Y electrode 190 are similar to those of the first electrode portion 181, the second electrode portion 182, the third electrode portion 183 and the connecting portions 184 of the X electrode 180 as described above. Thus repetitive detailed description will be omitted.

Light absorbing layers 140 are arranged between adjacent sustain electrode pairs 112. A light absorbing layer 140 is arranged on the first substrate 111 and corresponds to a second barrier portion 130*b*. Collectively, the light absorbing layers 140 absorb visible rays incident from outside the plasma display panel and reduce reflection brightness to increase contrast. In the present exemplary embodiment, the light absorbing layers 140 may have a stripe shape. If the light absorbing layers 140 are formed of the same material as the X electrodes 180 and the Y electrodes 190, the light absorbing layers 140 can be formed simultaneously with the X electrodes 180 and the Y electrodes 190. Thus, the manufacturing process of the plasma display panel can be simplified. The line width C of a light absorbing layer 140 may be between about 50 μm to about 200 μm.

The first dielectric layer 115 is formed on the front substrate 111 to cover the X electrodes 180 and the Y electrodes 190. The first dielectric layer 115 prevents electrical connection between adjacent X electrodes 180 and Y electrodes 190 during discharge. The first dielectric layer 115 also prevents the X electrodes 180 and the Y electrodes 190 from being damaged due to direct collision with positive ions or electrons during discharge. The first dielectric layer 115 may be formed of a dielectric, such as PbO, $B_2O_3$, or $SiO_2$, that induces charged particles to accumulate as wall charges.

Tn addition, the protective layer 116, which can be formed of MgO, is formed on and covers the first dielectric layer 115. The protective layer 116 prevents the first dielectric layer 115 from being damaged by collision of positive ions and electrons during discharge. The protective layer 116 may have excellent light transmission and may emit secondary electrons during discharge. The protective layer 116 may be formed of a thin film by sputtering or electron beam deposition.

The address electrodes 122 are arranged on the second substrate 121 and face the first substrate 111 to cross with the X electrodes 180 and the Y electrodes 190. The address electrodes 122 generate an address discharge in a discharge cell 170, which promotes a sustain discharge between an X electrode 180 and a Y electrode 190 and lowers the voltage necessary for generating a sustain discharge. An address discharge is generated between a Y electrode 190 and an address electrode 122 within a discharge cell 170. When the address discharge is complete, positive ions accumulate at the Y electrode 190 and electrons accumulate at the X electrode 180. Thus, sustain discharge between the X electrode 180 and the Y electrode 190 is assisted.

The second dielectric layer 125 is formed on the second substrate 121 to cover the address electrodes 122. The second dielectric layer 125 prevents the address electrodes 122 from being damaged by collision with positive ions or electrons during discharge. The second dielectric layer 125 may be formed of a dielectric, such as PbO, $B_2O_3$, or $SiO_2$, that induces charged particles to accumulate as wall charges.

Phosphor layers 126 may be formed on the second dielectric layer 125 between barrier ribs 130 and along the side surfaces of the barrier ribs 130. The phosphor layers 126 may have components for receiving ultraviolet rays and generating visible light rays. The visible light rays may have colors such as red, green, and blue, and each discharge cell 170 may be designated by the color of light that is emitted from the discharge cell, such as a red discharge cell, a green discharge cell, or a blue discharge cell. The phosphor layer 126 arranged in a red discharge cell may contain a phosphor such as $Y(V,P)O_4$:Eu, the phosphor layer 126 arranged in a green discharge cell may contain a phosphor such as $Zn_2SiO_4$:Mn, $YBO_3$:Tb, and the phosphor layer 126 arranged in a blue discharge cell may contain a phosphor such as BAM:Eu.

Discharge gas such as Ne, Xe, or a mixture thereof is contained within the discharge cells 170. The first substrate 111 and the second substrate 121 can be coupled together with a sealing member (not shown) such as frit glass formed along the edges of the first substrate 111 and the second substrate 121 to seal the substrates and contain the discharge gas.

The operation of the plasma display panel 100 according to the present exemplary embodiment having the aforementioned structure is as described below.

The address discharge is generated by applying an address voltage between an address electrode 122 and a Y electrode 190, which cross with each other at a discharge cell 170, to select the discharge cell 170 in which sustain discharge will be generated. Thereafter, a sustain voltage is applied between an X electrode 180 and a Y electrode 190 of the selected discharge cell 170. The sustain voltage causes positive ions accumulated at the Y electrode 190 and electrons accumulated at the X electrode 180 to collide with each other and generate a sustain discharge. The sustain discharge is repeated to achieve the desired intensity of light emitted from the discharge cell 170 by alternately applying the voltage pulse to the X electrode 180 and the Y electrode 190. For example, where the sustain voltage is designated as Vs, sustain discharge may be initiated by applying sustain voltage Vs to the X electrode 180 of the selected discharge cell 170 and ground voltage 0V to the Y electrode 190 of the selected discharge cell 170. Then, sustain discharge may be repeated by applying sustain voltage Vs to the Y electrode 190 and ground voltage 0V to the X electrode 180. Alternatively, sustain discharge may be generated by alternately applying +Vs/2 and −Vs/2 to the X electrode 180 and the Y electrode 190 of the selected discharge cell 170. During sustain discharge between the X electrode 180 and the Y electrode 190, the sustain discharge is initiated between the third electrode portion 183 of the X electrode 180 and the third electrode portion 193 of the Y electrode 190, since these portions are closest between the two electrodes of the sustain electrode pairs 112. The sustain discharge then sequentially diffuses into the second electrode portion 182 and second electrode portion 192 and then into the first electrode portion 181 and the first electrode portion 191.

Accordingly, the discharge gas in the selected discharge cell 170 is excited by the sustain discharge. After the energy level of the discharge gas drops, ultraviolet rays are emitted from the discharge gas. The ultraviolet rays excite the phosphor layer 126 arranged in the discharge cell 170. When the energy level of the excited phosphor layer 126 drops, visible light rays are emitted from the phosphor layer 126 and from the selected discharge cell 170 to form an image on the plasma display panel.

The X electrodes 180 and the Y electrodes 190 generate the sustain discharge, but also prevent the visible rays emitted from the phosphor layers 126 from being emitted through the first substrate 111. As the areas of the X electrodes 180 and the Y electrodes 190 increase, the efficiency of the sustain discharge also increases, thus increasing the amount of visible rays emitted from the phosphor layers 126. However, if the areas of the X electrodes 180 and the Y electrodes 190 increase excessively, the X electrodes 180 and the Y electrodes 190 block the light emitted from the phosphor layers 126 from emitting through the front substrate 111. The increase in area of the X electrodes 180 and the Y electrodes 190 reduces an aperture ratio of a discharge cell 170 and may also reduce brightness of light emitted from the plasma display panel. Further, power consumption may increase unnecessarily. Accordingly, the structure of the X electrode 180 and the Y electrode 180 must be optimized to balance the efficiency of the sustain discharge and the power consumed by the PDP.

Since the first electrode portion 181, the second electrode portion 182, and the third electrode portion 183 of the X electrode 180 and the first electrode portion 191, the second electrode portion 182, and the third electrode portion 193 of the Y electrode 190 are arranged substantially in parallel and have large facing areas, they are important elements in the generation of the sustain discharge. However, since the connection portions 184 of the X electrode 180 and the connection portions 194 of the Y electrode 190 have small facing areas and cross the middle portions of the discharge cells 170, they may block emission of the visible rays generated in the discharge cells 170. However, a connection portion 184 of the X electrode 180 smoothly diffuses the discharge from the third electrode portion 183 to the second electrode portion 182 and from the second electrode portion 182 to the first electrode portion 181. Similarly, a connection portion 194 of the Y electrode 190 smoothly diffuses the discharge from the third electrode portion 193 to the second electrode portion 192 and from the second electrode portion 192 to the first electrode portion 191. Accordingly, the connection portions 184 and the connection portions 194 are important elements in the structure and operation of the X electrode 180 and the Y electrode 190.

If the connection portions 184 did not exist to diffuse the sustain discharge to subsequent electrode portions, discharge would not diffuse smoothly and the total brightness of light emitted from the plasma display panel may be reduced. This is because no electrode portions would exist between the third electrode portion 183 and the second electrode portion 182, and between the second electrode portion 182 and the first electrode portion 181. Therefore, the amount of accumulated wall charges between these electrode portions would be very small and sustain discharge may not diffuse. If the connection portions 194 did not exist to diffuse the sustain discharge to subsequent electrode portions, discharge would not diffuse smoothly and the total brightness of light emitted from the plasma display panel may be reduced for the reasons as explained above for the connection portions 184.

Accordingly, in the present invention, to improve the brightness of light emitted from the plasma display panel and reduce the power consumption, the line width B of the first electrode portion 181, the second electrode portion 182, and the third electrode portion 183 of the X electrode 180, 191, 192, and 193 and the first electrode portion 191, the second electrode portion 192, and the third electrode portion 193 of the Y electrode 190 and the line width S of the connection portions 184 of the X electrode 180 and connection portions 194 of the Y electrode 190 are derived as a parameter. Specifically, the ratio S/B of the line width S of the connection portions 184 of the X electrode 180 to the constant line width B of the first electrode portion 181, the second electrode portion 182, and the third electrode portion 183 of the X electrode 180 is a dimensionless constant. Similarly, the ratio S/B of the line width S of the connection portions 194 to the constant line width B of the first electrode portion 191, the second electrode portion 192, and the third electrode portion 193 of the Y electrode 190 is also a dimensionless constant.

Figure 5:
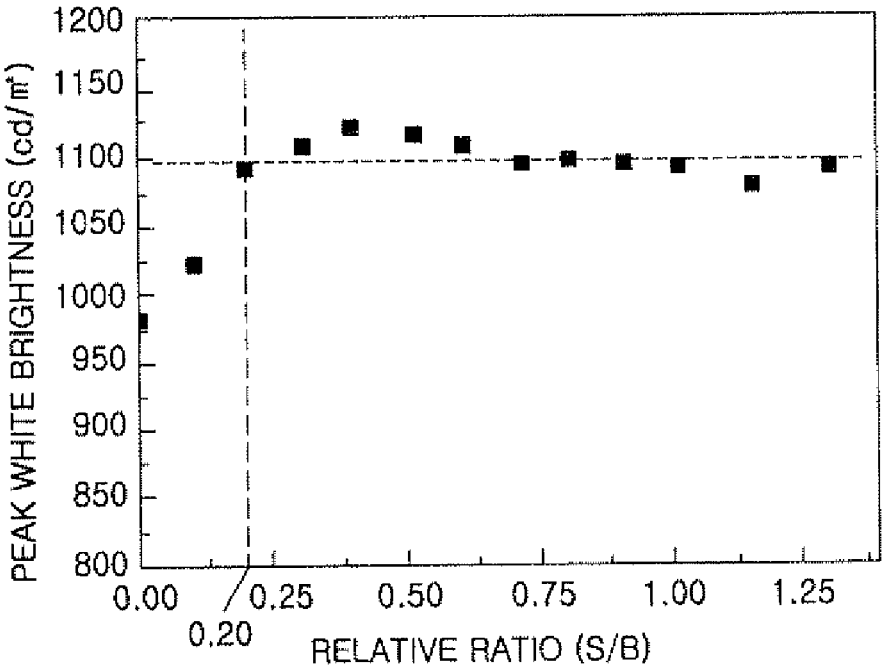
FIG. 5 is a graph illustrating 1% peak white brightness vs. the ratio (S/B) of the line width S of a connection portion to the line width B of an electrode portion of the sustain electrode.
Figure 6:
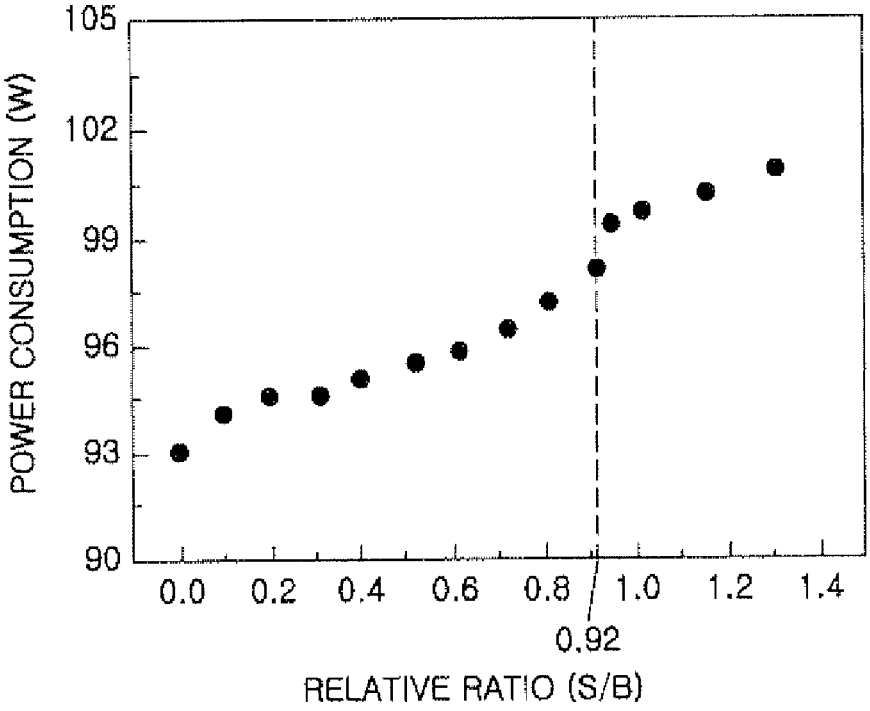
FIG. 6 is a graph illustrating power consumption vs. the ratio (S/B) of the line width S of a connection portion to the line width B of an electrode portion of the sustain electrode.

FIG. 5 illustrates the result of measuring 1% peak white brightness while varying the ratio S/B, and FIG. 6 illustrates the result of measuring power consumption while varying the ratio S/B. The 1% peak white brightness represents the brightness of light emitting from the plasma display panel when 1% of the discharge cells 170 are discharged and 99% are not discharged, where the total display area of the plasma display panel constitutes 100%.

For the experiments upon which FIG. 5 and FIG. 6 are based, the line width B of the first electrode portion 181, the second electrode portion 182, and the third electrode portion 183 of the X electrode 180 and the line width B of the first electrode portion 191, the second electrode portion 192, and the third electrode portion 193 of the Y electrode 190 are set to 55 μm, and the line width C of the light absorbing layer 140 is set to 75 μm. The distance D1 between the second electrode portion 182 and the third electrode portion 183 of the X electrode 180, the distance D2 between the first electrode portion 181 and the second electrode portion 182 of the X electrode 180, the distance E1 between the second electrode portion 192 and the third electrode portion 193 of the Y electrode 190, and the distance E2 between the first electrode portion 191 and the second electrode portion 192 of the Y electrode 190 are set to 95 μm. The distance G between the third electrode portion 183 of the X electrode 180 and the third electrode portion 193 of the Y electrode 190 is set to 95 μm. The distance F1 between the first electrode portion 181 of the X electrode 180 and the light absorbing layer 140, and the distance F2 between the first electrode portion 191 of the Y electrode 190 and the light absorbing layer 140 are set to 115 μm. Therefore, for these experiments, the ratio S/B has been varied by changing the line widths S of the connection portions 184 and the connection portions 194.

As plotted in FIG. 5 and shown in TABLE 1 below, the ratio S/B has values of 0.00, 0.10, 0.20, 0.31, 0.40, 0.52, 0.61, 0.72, 0.84, 0.92, 1.02, 1.16, and 1.31, and the corresponding 1% peak white brightness has values of 980.00, 1020.00, 1090.00, 1108.00, 1120.00, 1116.00, 1107.62, 1095.00, 1095.56, 1094.90, 1091.37, 1077.24, and 1090.00 cd/m$^2$, respectively.

TABLE 1

| S/B | 1% peak white brightness |
|---|---|
| 0.00 | 980 |
| 0.10 | 1020 |
| 0.20 | 1090 |
| 0.31 | 1108 |
| 0.40 | 1120 |
| 0.52 | 1116 |
| 0.61 | 1107.62 |
| 0.72 | 1095 |
| 0.84 | 1095.56 |
| 0.92 | 1094.90 |
| 1.02 | 1091.37 |
| 1.16 | 1077.24 |
| 1.31 | 1090 |

As shown in FIG. 5, the 1% peak white brightness is significantly reduced if the ratio S/B is set less than 0.20. If the ratio S/B decreases from 0.20 to 0.10, the 1% peak white brightness decreases from 1090.00 cd/m$^2$ to 1020.00 cd/m$^2$, which is a decrease of about 6.42%. Thus, where the ratio S/B is reduced excessively, the line widths S of the connection portions 184 are reduced and the sustain discharge generated in the third electrode portion 183 of the X electrode 180 cannot diffuse smoothly into the second electrode portion 182 and into the first electrode portion 181. Similar diffusion is hindered in the Y electrode 190. However, where the ratio S/B is equal to or greater than 0.20, the 1% peak white brightness is around 1100 cd/m$^2$. Where the ratio S/B equals 0.40, the 1% peak white brightness has a maximum value of 1120 cd/m$^2$. Accordingly, an S/B ratio that is greater than or equal to 0.20 provides a preferred intensity of brightness.

As plotted in FIG. 6 and shown in TABLE 2 below, the ratio S/B has values of 0.00, 0.10, 0.20, 0.31, 0.40, 0.52, 0.61, 0.72, 0.84, 0.92, 0.95, 1.02, 1.16, and 1.31, and the corresponding power consumption has values of 93.05, 94.10, 94.59, 94.59, 95.01, 95.44, 95.78, 96.37, 97.13, 98.07, 99.28, 99.67, 100.19, and 100.78 W, respectively.

TABLE 2

| S/B | Power consumption |
|---|---|
| 0.00 | 93.05 |
| 0.10 | 94.10 |
| 0.20 | 94.59 |
| 0.31 | 94.59 |
| 0.40 | 95.01 |
| 0.52 | 95.44 |
| 0.61 | 95.78 |
| 0.72 | 96.37 |

TABLE 2-continued

| S/B | Power consumption |
|---|---|
| 0.84 | 97.13 |
| 0.92 | 98.07 |
| 0.95 | 99.28 |
| 1.02 | 99.67 |
| 1.16 | 100.19 |
| 1.31 | 100.78 |

As shown in FIG. 6, power consumption increases as the ratio S/B increases. Particularly, the power consumption significantly increases as the ratio S/B increases from 0.92 to 0.95. As the ratio S/B increases from 0.20 to 0.92, the power consumption increases by 3.48 W, which results in a slope of 4.83 W calculated by change in rise over change in run. However, as the ratio S/B increases from 0.92 to 0.95, the power consumption increases by 1.21 W, which results in a much larger slope of 40.3 W. This slope is 8.34 times greater than the case where the ratio S/B is less than or equal to 0.92. This is because when the line width S of the connection portions 184 are much less than the line width B of the first electrode portion 181, the second electrode portion 182, and the third electrode portion 183 of the X electrode 180, the connection portions 184 aid in discharge and discharge diffusion. Thus, the increase in power consumption is small. However, if the line widths S of the connection portions 184 are greater than or similar to the line width B of the first electrode portion 181, the second electrode portion 182, and the third electrode portion 183 of the X electrode 180, the connection portions 184 become main discharge paths, current consumption increases, and the power consumption increases as a result. The line width S of the connection portions 194 have similar impacts on the power consumption of the plasma display panel. Accordingly, a ratio S/B equal to 0.92 or less may decrease the PDP power consumption.

Based on this experiment, the ratio S/B may be in the range of 0.20 to 0.92 to effectively balance the brightness and the power consumption.

Thus, a plasma display panel according to the present invention has the following advantages. First, since the line widths of the connection portion and the electrode portions of the sustain electrodes are optimized, power consumption can be reduced. Second, since the sustain electrode can be integrally formed, the manufacturing costs can be reduced and the manufacturing process can be simplified.

According to the plasma display panel of the present invention, a plasma display panel that can be manufactured easily and has improved brightness and reduced power consumption is provided.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

a first substrate;

a second substrate facing the first substrate; and a first pair of sustain electrodes arranged between the first substrate and the second substrate to generate a sustain discharge, wherein a first sustain electrode of the first pair of sustain electrodes includes a first electrode portion, a second electrode portion, and a connection portion for electrically coupling the first electrode portion and the second electrode portion, and a ratio S/B of a line width S of the connection portion to a line width B of the first electrode portion is $0.20 \leqq S/B \leqq 0.92$, and wherein a distance D2 between the first electrode portion and the second electrode portion and a distance G between the first sustain electrode and a second sustain electrode of the first pair of sustain electrodes are equal.

2. The plasma display panel of claim 1, wherein the first electrode portion and the second electrode portion extend in a first direction substantially parallel to each other.

3. The plasma display panel of claim 2, wherein a connection portion extends in a second direction substantially perpendicular to the first direction.

4. The plasma display panel of claim 1, wherein the first sustain electrode further includes a third electrode portion and a second connection portion for electrically coupling the third electrode portion with the second electrode portion, and the third electrode portion extends substantially parallel to the first electrode portion and the second electrode portion.

5. The plasma display panel of claim 1, wherein the line width of the first electrode portion is about 20 μm to about 150 μm.

6. The plasma display panel of claim 1, wherein the first electrode portion and the second electrode portion have substantially the same line width B.

7. The plasma display panel of claim 1, wherein the connection portion, the first electrode portion, and the second electrode portion are integrally formed.

8. The plasma display panel of claim 1, wherein the first sustain electrode comprises a conductive metal material.

9. The plasma display panel of claim 8, wherein the first sustain electrode comprises a material selected from the group consisting of Ag, Pt, Pd, Ni, and Cu.

10. The plasma display panel of claim 1, wherein the first sustain electrode comprises a conductive ceramic material.

11. The plasma display panel of claim 10, wherein the first sustain electrode comprises Indium Tin Oxide (ITO) or Antimony Tin Oxide (ATO).

12. The plasma display panel of claim 1, wherein the first sustain electrode comprises carbon nanotubes.

13. The plasma display panel of claim 1, further comprising: a light absorbing layer absorbing light incident from outside the plasma display panel.

14. The plasma display panel of claim 13, further comprising:

a second pair of sustain electrodes arranged between the first substrate and the second substrate and adjacent to the first pair of sustain electrodes, wherein the light absorbing layer is disposed between the first pair of sustain electrodes and the second pair of sustain electrodes.

15. The plasma display panel of claim 13, wherein the light absorbing layer is disposed in a stripe shape.

16. The plasma display panel of claim 13, wherein a line width of the light absorbing layer is about 50 μm to about 200 μm.

17. A plasma display panel, comprising:

a first substrate;

a second substrate facing the first substrate;

barrier ribs arranged between the first substrate and the second substrate and defining a plurality of discharge cells;

address electrodes which extend in a first direction and cross with discharge cells;

a plurality of sustain electrode pairs, which extend in a second direction and cross with the address electrodes;

a first dielectric layer which covers the sustain electrodes;

a second dielectric layer which covers the address electrodes;

phosphor layers disposed in the discharge cells; and discharge gas disposed between the first substrate and the second substrate in the discharge cells, wherein a first sustain electrode of a sustain electrode pair includes a first electrode portion, a second electrode portion, and a connection portion for electrically coupling the first electrode portion and the second electrode portion, and wherein a distance D2 between the first electrode portion and the second electrode portion and a distance G between the first sustain electrode and a second sustain electrode of the sustain electrode pair are equal.

18. The plasma display panel of claim 17, wherein a ratio S/B of a line width S of the connection portion to a line width B of the first electrode portion or the second electrode portion is $0.20 \leqq S/B \leqq 0.92$.

19. The plasma display panel of claim 17, wherein a second sustain electrode of the sustain electrode pair has a substantially equivalent structure as the first sustain electrode.

20. A plasma display panel, comprising:

a first substrate;

a second substrate facing the first substrate; and a sustain electrode arranged between the first substrate and the second substrate, and including a first electrode portion and a second electrode portion both extending in a first direction, and a connection portion coupled between the first electrode portion and the second electrode portion and extending in a second direction, wherein the first direction is substantially perpendicular to the second direction, and a ratio S/B of a line width S of the connection portion to a line width B of the first electrode portion is $0.20 \leqq S/B \leqq 0.92$, and wherein a distance D2 between the first electrode portion and the second electrode portion and a distance G between the first sustain electrode and an adjacent sustain electrode are equal.

* * * * *